United States Patent [19]

Grenfell

[11] Patent Number: 4,650,414

[45] Date of Patent: Mar. 17, 1987

[54] REGENERATIVE HEAT EXCHANGER APPARATUS AND METHOD OF OPERATING THE SAME

[75] Inventor: Thomas N. Grenfell, Somerville, N.J.

[73] Assignee: Somerset Technologies, Inc., New Brunswick, N.J.

[21] Appl. No.: 796,259

[22] Filed: Nov. 8, 1985

[51] Int. Cl.[4] ..... F23D 14/00; F23G 7/08; F23J 15/00

[52] U.S. Cl. ..... 431/5; 110/211; 110/212; 422/173; 422/175; 422/182

[58] Field of Search ..... 110/211, 212; 431/5; 422/173, 175, 182, 183, 1, 2

[56] References Cited

U.S. PATENT DOCUMENTS

| | | | |
|---|---|---|---|
| 1,940,371 | 5/1930 | Royster | 257/6 |
| 2,121,733 | 8/1935 | Cottrell | 183/6 |
| 3,870,474 | 3/1975 | Houston | 23/277 |
| 3,895,918 | 7/1975 | Mueller | 23/277 |
| 4,302,426 | 11/1981 | Benedick | 422/173 |
| 4,454,826 | 6/1984 | Benedick | 110/211 |
| 4,474,118 | 10/1984 | Benedick | 110/211 |

*Primary Examiner*—Edward G. Favors

*Attorney, Agent, or Firm*—Fay, Sharpe, Fagan, Minnich & McGee

[57] ABSTRACT

A regenerative system for purifying mixtures of air and impurities by a combination process. The system includes a plurality of fixed bed regenerative heat exchangers connected to a common combustion chamber. Each of the heat exchangers includes means for diverting selected portions of the gases flowing therethrough out of heat exchange relationship with the heat exchange packing or bed therein. This permits the system to operate with incoming air-impurities mixtures containing high levels of combustibles without generating undesirably high temperatures or changing the mass flow rate through the system.

18 Claims, 3 Drawing Figures

REGENERATIVE HEAT EXCHANGER APPARATUS AND METHOD OF OPERATING THE SAME

BACKGROUND OF THE INVENTION

The subject invention is directed toward the art of regenerative heat exchange systems and, more particularly, to a regenerative incinerator system.

The invention is particularly suited for use in fixed bed regenerative incinerator systems and will be described with particular reference thereto; however, the invention is capable of broader application and could be used in a variety of such systems.

Fixed bed regenerative incinerator systems are commonly used to remove contaminants such as odors, impurities, and noxious off-gases from air exiting from various manufacturing processes. The systems perform the removal process by subjecting the contaminants to sufficient heat and oxygen to cause them to oxidize.

Systems of this general type are shown, for example, in U.S. Pat. Nos. 3,895,918 and 3,870,474. Generally, the systems include two or more fixed bed regenerative heat exchangers connected to a common combustion or incinerator chamber. The contaminant laden air is conducted through one of the heat exchangers where it is heated. Thereafter, it is conducted to the combustion chamber where the contaminants are burned and completely oxidized, generally with the addition of a hydrocarbon fuel. The hot combustion gases are then exhausted through another of the heat exchangers where they give up a major portion of their heat content before being discharged to the atmosphere.

Periodically, flow through the system is reversed. The incoming contaminate laden air is then heated by the heat exchanger which was previously heated by the exiting combustion gases, and the heat exchanger previously cooled by the incoming air is reheated by the exiting combustion gases.

The amount of hydrocarbon fuel which must be introduced into the combustion chamber depends to a large extent on the amount of heat released by the combustible contaminants in the incoming air stream. For example, when the systems are used to eliminate organic solvent vapors, the incoming air stream can easily contain enough solvent vapors to make the process self-sustaining. That is, the required combustion takes place without the need to supply additional fuel to the combustion or incinerator chamber. In fact, a problem often encountered is that the total energy content in the solvent vapors can be such as to cause the system to exceed its maximum operating temperature and go out of control, thereby requiring shut-down.

The prior art has proposed several methods and apparatus for dealing with the noted problem. One method has been to increase the volume of air passing through the unit so that the additional air will absorb the excess heat generated by the excess solvent. A second method has been to bleed gases from the combustion chamber before they enter the downstream or exit heat exchanger. This allows a desired level of heat exchange to be maintained on the entry heat exchanger. A third method has been to purge each heat exchanger with fresh outside air with each reversal of flow. The method results in cooling each heat exchanger to thereby reduce the ultimate maximum temperature reached during operation.

While the approaches discussed have somewhat alleviated the problem, they have not been entirely satisfactory. For example, increasing air flow through the units and fresh air purging generally require increasing the size of various components to handle the increased air flow, as well as the installation of additional air blowers, etc. In addition, with these prior systems it is not, of course, possible to control mass flow through the system.

BRIEF SUMMARY OF THE INVENTION

The subject invention provides a method and apparatus wihch overcomes the above-discussed problems and, in effect, allows a fixed bed regenerator system of the type described to function like a variable bed regenerator system.

In accordance with one aspect of the invention, there is provided a fixed bed regenerative incinerator system which includes first and second fixed bed regenerative heat exchangers each including a chamber having a gas permeable heat exchange packing therein. The two chambers are connected to a combustion chamber by a gas flow conduit means which allows gas to flow serially through one heat exchanger to the combustion chamber and from the combustion chamber through the other of the heat exchangers. Means are also provided to allow the direction of gas flow through the system to be periodically reversed. In addition, associated with each of the heat exchangers are means for regulating the gas flow through the heat exchangers so that controlled quantities of the gas can be selectively brought into heat exchange relationship with the gas permeable packing.

Through the use of the apparatus described, the system can handle incoming air streams which contain high levels of combustible contaminants such as organic solvent vapors. Note that by passing only portions of the incoming gas stream through the upstream heat exchanger the temperature of the mixture of air and combustible impurities is not raised to an extremely high level before it is brought to the combustion chamber. Similarly, by passing only a portion of the exiting exhaust gases through the downstream heat exchanger packing less of the heat in these gases is recovered. Thus, during cycling of flow direction the total temperature build-up within the system can be controlled. In addition, it is important to note that the arrangement does not change the mass flow rate through the system.

In accordance with another aspect of the invention there is provided a method of operating a fixed bed regenerative system of the type described. In general, the improved method comprises monitoring a parameter indicative of the quantity of combustibles in the gas mixture supplied through the first heat exchanger to the incinerating chamber and, when the quantity of the combustibles reach a predetermined level, stopping the flow of fuel to the incinerator chamber while diverting a portion of the air and combustibles mixture supplied through the heat exchanger out of heat exchange relationship with the packing therein.

A still further aspect of the invention includes the additional step of increasing the portion of the mixture diverted if the quantity of the combustibles rises above the predetermined level.

Yet another aspect of the invention includes the additional step of diverting a portion of the exhaust gases passing through the second heat exchanger out of heat exchange relationship with the packing therein when the quantity of combustibles reach or exceed the predetermined level.

As is apparent, the monitoring of the combustible levels can be achieved in many different ways. Among the simpler ways of monitoring are to continually monitor the temperature level within the combustion chamber in conjunction with the pressure within the chamber. As the tempeature and/or pressure increase an increase in combustibles is indicated.

Accordingly, a primary object of the subject invention is the provision of an improved fixed bed regenerative incinerator system and a method of operating the same which allows a fixed bed regenerator system to function much in the manner of a variable bed regenerator system.

A still further object is a provision of an apparatus of the type described wherein exhausted gas and/or incoming air flow through the regenreative heat exchangers can be diverted around the heat exchange packing in response to increases in the combustible levels in the incoming air stream.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
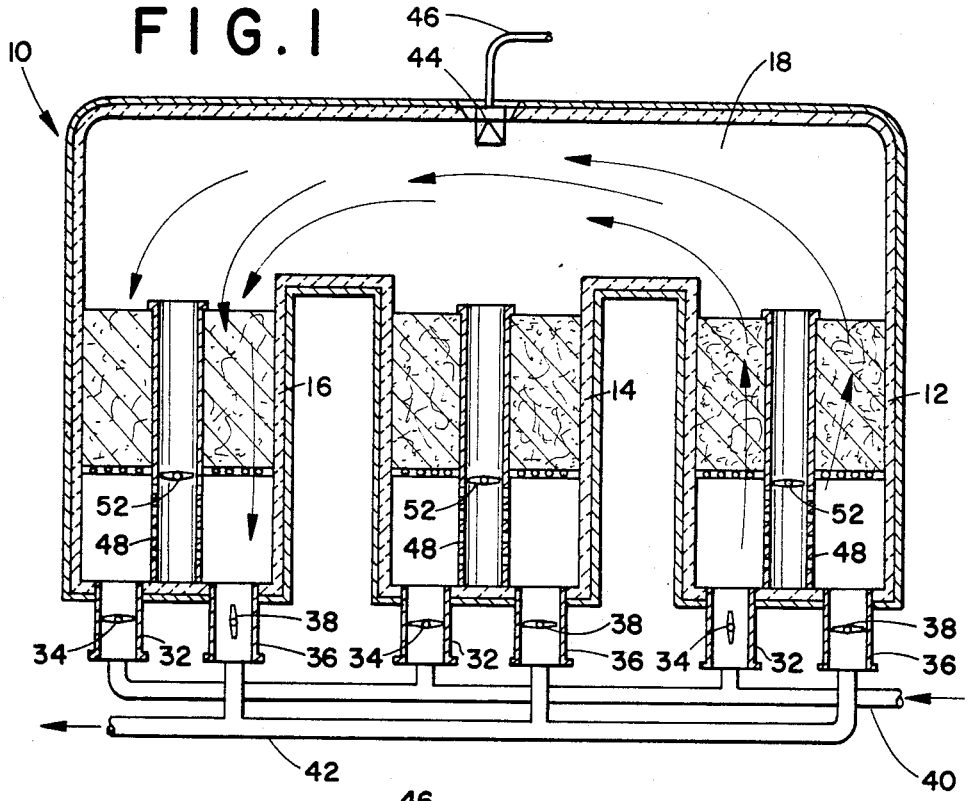
FIG. 1 is a diagramatic view of a system embodying the subject invention.

Referring more particularly to the drawings wherein the showings are for the purpose of illustrating a preferred embodiment of the invention only, and not for the purpose of limiting same, FIG. 1 shows in somewhat diagramatic form a typical regenerative incinerator system 10. Such systems typically include two or more regenerative heat exchangers connected in series through an incineration or combustion chamber. In the embodiment illustrated, the subject system includes three regenerative heat exchangers 12, 14 and 16 connected in gas flow communication with an incineration or combustion chamber 18. The construction of each of the regenerative heat exchangers 12, 14 and 16 is illustrated as being substantially identical although, as will be apparent to those skilled in the art, the construction of these could vary. Specifically, the actual construction of the heat exchangers can best e understood by reference to FIGURE 3. As shown, the heat exchangers 12, 14 and 16 each preferably comprise an outer shell or wall 20 of generally cylindrical configuration and formed, for example, with a metal outer shell 22 lined with a suitable heat resistant refractory material 24. A bottom wall 26 extends transversely across the lower end of wall 20 to define a closed, heat exchange chamber.

Mounted within the heat exchange chamber and located a distance above the bottom wall 26 is a gas permeable heat exchange mass or bed 28. The bed 28 can be formed of any of several commercially available, heat resistant ceramic or metallic elements well known in the art. The elements are shaped and designed so that when stacked or placed in a bed configuration, gas can flow therethrough in a multiplicity of random paths. In the embodiment under consideration, the bed of elements 28 is supported at the location shown by a transversely extending gas permeable support grid 30 also formed of a suitable metal or ceramic material.

As mentioned, the bed 28 is designed so that gas can flow freely therethrough in either direction. Heat exchange takes place between the bed packing elements or material and the gas to heat either the packing or the gas depending upon their relative temperatures.

Connected to the lower end of the heat exchanger shell 20 is an inlet duct or pipe 32 which has a suitable damper or valve 34 rotatably mounted therein. Also connected to the lower end of the shell 20 is a discharge duct or pipe 36 having a similar valve 38 carried therein.

Referring again to FIG. 1, it will be noted that the inlet pipes 32 of each of the heat exchangers 12, 14 and 16 are connected to a supply line 40 through which a mixture of air and impurities including fumes, odors and particulate material is supplied. As can be understood, the mixture of air, objectionable impurities and combustibles is supplied to the system from a manufacturing process or the like (not shown). It should be appreciated that, if necessary, suitable fans or blowers can be associated with line 40 for supplying the air-combustible mixture therethrough.

The discharge ducts or tubes 36 are likewise connected in common to a line or discharge pipe 42 leading to a suitable stack or chimney (not shown) for exhausting the purified air mixture and combustion products to atmosphere.

In the embodiment under consideration, the upper ends of the regenerative heat exchangers 12, 14 and 16 are shown as opening directly into the incinerator or combustion chamber 18. It should, of course, be understood that the upper ends of the regenerative heat exchangers could be connected to a separately mounted and located combustion chamber through the use of refactory pipes or tubes. As shown, the combustion chamber 18 connects all three of the regenerative heat exchangers in fluid flow relationship and has a fuel burner 44 mounted generally centrally thereof. The fuel burner 44 is supplied with a hydrocarbon fuel such as oil through a valved supply line 46. Although not shown, it should be appreciated that burner 44 is provided with the customary combustion controls as is conventional in the art.

The apparatus thus far decribed is conventional and the details of its construction are not critical to the invention. In using the apparatus described, a mixture of air containing objectionable fumes, impurities and combustibles is supplied through line 40. In the FIG. 1 showing, only the inlet to regenerative heat exchanger 12 is open to permit gas to flow from line 40 through the heat exchange packing or bed therein. As the air mixture flows through the bed in heat exchanger 12, it is heated and thereafter discharges to the combustion chamber 18. The combustion chamber 18 is at a relatively high temperature as a result of the input of burner 44.

The air and combustibles mixture to be purified and entering the combustion chamber 18 from the heat exchanger 12 intermixes with the combustion gases and burning fuel supplied through burner 44 and the objectional fumes, odors and combustible materials in the mixtue are oxidized. Thereafter, the exhaust gases from the combustion process are conducted through heat exchanger 16. It should be noted that the valves 34, 36 of heat exchanger 14 are closed so that during the mode of operation shown in FIG. 1, all of the exhaust gases pass through heat exchanger 16.

In heat exchanger 16 the hot exhaust or combustion gases from combustion chamber 18 pass through the packing or bed and in so doing heat the bed significantly prior to pasing out of the heat exchanger through discharge tube 36. The purified gases exiting from tube 36 are, of course, discharged to the atmosphere through line 42 to a fan or suitable blower discharging to a chimney or the like (not shown).

Figure 2:
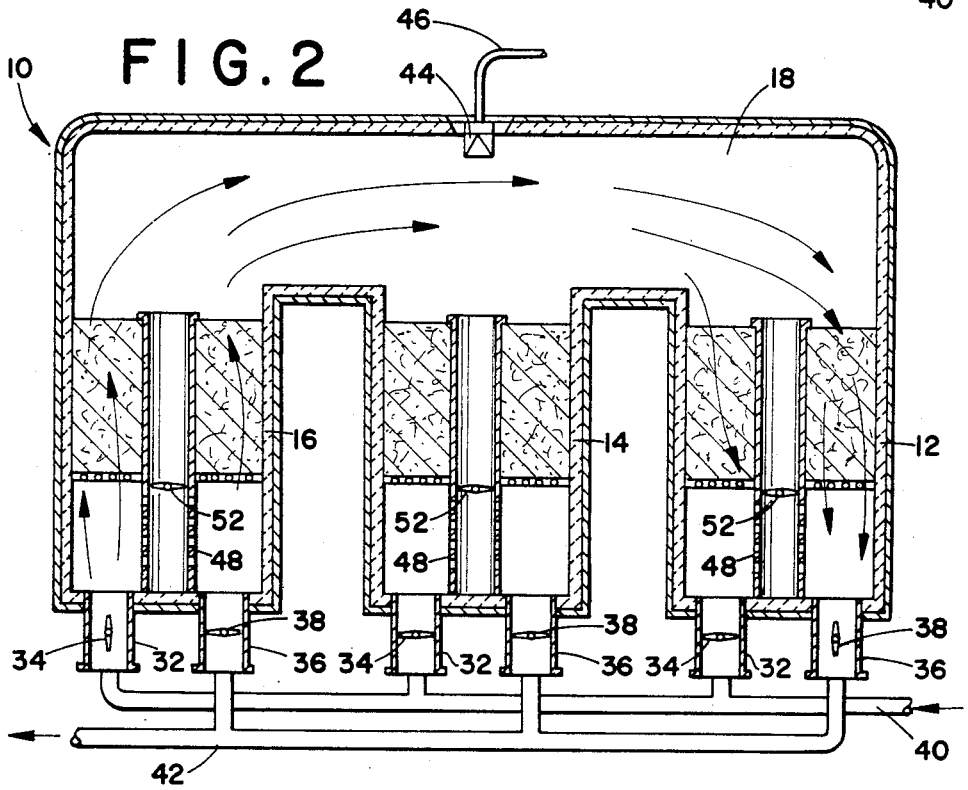
FIG. 2 is a view similar to FIG. 1 but showing the appartus in a different mode of operation; and, FIG. 3 is an enlarged vertical cross-sectional view through one of the fixed bed regenerative heat exchangers of FIG. 1.

After a predetermined period of operation as depicted in FIG. 1, the packing within regenerative heat exchanger 12 is substantially cooled and the packing within heat exchanger 16 has been heated to a relatively high temperature. At that time, inlet valve 34 of heat exchanger 12 is closed while the corresponding inlet valve of heat exchanger 16 is opened. Similarly, the discharge valve of heat exchanger 12 is opened and the discharge valve 38 of the heat exchanger 16 is closed. The flow through the unit is thereby reversed and the packing or heat exchange bed in heat exchanger 16 is cooled as it heats the incoming air and impurities mixture. Similarly, the packing in heat exchanger 12 is reheated by the hot exhaust gases exiting from the incineration or combustion chamber 18. This method of operation is depicted in FIG. 2.

With the three heat exchangers as shown, the cycling and reversal of flow between the heat exchangers can be carried out smoothly so that there is no interruption in the flow of the exhaust gas impurities mixture through line 40. In addition, the heat exchanger not in the cycle at any particular time can act in the manner of a surge tank to prevent flow interruption while the changeover takes place. The apparatus and method thus far described is common and well known.

As can be appreciated, the amount of fuel which must be supplied through fuel burner 44 to sustain proper combustion within chamber 18 depends on a variety of factors. For example, the overall efficiency of the unit, the temperature of the incoming air and impurities mixture supplied through line 40, and the quantity of heat available from burning of the combustibles in the incoming air-impurities mixture, all have an effect on the quantity of fuel which must be supplied through burner 44. For example, if the quantity of heat available in the combustible-impurities rises to a certain minimum level, combustion within chamber 18 can be self-sustaining and no fuel needs to be supplied through burner 44. This condition is frequently encountered in systems wherein the mixture of air and impurities is coming from a manufacturing process using solvents. The solvent vapors in the air mixture can readily rise to a level where self-sustaining operation of the unit is possible. In addition, with continual increase of the quantity of combustibles, the temperatures within the system can rise to undesirable levels and the system can be said to go out of control and must be shut down. That is, the temperatures within the unit exceed the safe operating levels and structural damage to the system could result if operation were continued.

As previously discussed, in the past several different approaches have been used in an attempt to control overtemperature, and out of control conditions in these systems. One method has been to supply cool outside air through the heat exchangers with the air impurities mixture. Also, for example, hot gas bypasses have been provided to remove combustible exhaust gases from the combustion chamber upstream of the downstream heat exchanger. Another method proposed has been to purge the heat exchangers with cool outside air to prevent their temperatures from rising undesirably.

All of the noted methods have been somewhat less than completely satisfactory. As is apparent, all of the systems require additional equipment including blowers, piping and the like. In addition, all of the noted methods vary the mass flow rates through the system and, generally, increase the overall size of the equipment. The subject apparatus and method provides a way in which the noted problems can be overcome with a minimum of additional equipment and without varying the mass flow rate through the system.

Figure 3:
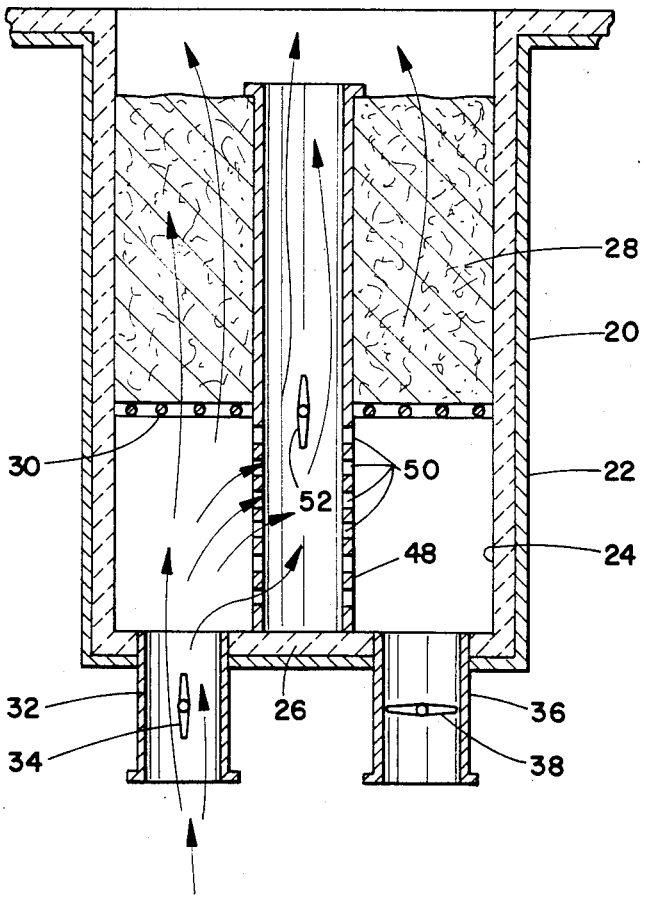

Referring specifically to FIG. 3, each of the heat exchangers 12, 14 and 16 are provided with means which allow controlled quantitites of the air-impurities mixture or the exhaust gases passing therethrough to be selectively diverted out of heat exchange relationship with the heat exchange bed or packing. As shown, each of the heat exchangers preferably includes a generally centrally mounted tube 48 which extends vertically through the heat exchange packing 28. In the embodiment under consideration, the tube 48 is formed from any suitable ceramic or other temperature resistant material and is supported from the bottom wall 26 of the chamber 20. The upper end of tube 48 opens above the heat exchange bed or packing 28. The lower end of tube 48 beneath the bed or packing 28 is provided with a multiplicity of openings 50. Suitably positioned within the tube 48 at a location preferably at least slightly above the openings 50 is a valve or damper 52. The valve or damper 52 can, of course, be operated either manually or automatically.

The use of the system thus far described can best be understood by reference to FIG. 2. Assume that the system has been operating under its normal cycled conditions and that the level of combustibles in the incoming air-impurities mixture have reached a level where the combustion process is self-sustaining without fuel being supplied through fuel burner 44. If the level of combustibles continues to rise, cycling of the unit results in gradually increasing temperature levels within the system. As can be appreciated, the amount of combustibles can be reflected in changes in a variety of different parameters, for example, incoming gas streams could be continuously analyzed, or the temperatures and/or pressures within the combustion chamber could be used as indicative of the level of incoming combustibles. In any event, when the quantity of combustibles rise to a certain minimum level beyond which the system could go out of control, the dampers or valves 52 in the regenerative heat exchangers 12, 14 and 16 can be modulated open. In the FIG. 2 showing the incoming air impurities mixture is flowing through regenerative heat exchanger 16 and the exhaust gases from the combustion chamber 18 are exiting through heat exchanger 12. Consequently, the dampers 52 in these two units would be open. Opening these two dampers allows a portion of the incoming air impurities mixture to bypass or flow around the heat exchange bed 28 in heat exchanger 16. Thus, the mixture as supplied to the combustion chamber 18 from heat exchanger 16 is not raised to as high a temperature level as would be the case if all of the mixture were passing through the heat exchange bed. Similarly, with the valve 52 open in heat exchanger 12 a portion of the exhaust gases leaving combustion chamber 18 are diverted about the packing 28 in heat exchanger 28. Thus, the packing is not raised to as high a temperature and the exhaust gases leaving the unit through tube 36 are at a somewhat higher temperature. Through proper modulation of the valves 52 the temperatures within the system can be closely controlled and the system can operate in the manner of a variable bed regenerator system. In addition, it should be noted that the total mass flow through the unit remains constant and it is possible to maintain the system operating at a desired temperature level with widely varying quantities of combustibles in the incoming air impurities mixture.

The invention has been described with reference to the preferred embodiment. Obviously, modifications and alterations will occur to those skilled in the art. It is intended to include all such modifications and alterations insofar as they come within the scope of the following claims or the equivalents thereof.

Having thus described the invention, it is now claimed:

1. A fixed bed regenerative incinerator system comprising:

(a) at least a first and second fixed bed regenerative heat exchanger each including a chamber having a gas permeable heat exchange packing therein;

(b) a combustion chamber;

(c) gas flow conduit means connecting each said heat exchanger to said combustion chamber to allow gas to flow serially through one heat exchanger to said combustion chamber and from said combustion chamber through the other of said heat exchangers, said gas flow conduit means further including means to periodically reverse the direction of said flow; and, (d) control means associated with each of said heat exchangers for permitting controllable amounts of gas to pass through said heat exchangers without passing through the packing therein when gas is either going to or coming from said combustion chamber.

2. A fixed bed regenerative incinerator system comprising:

(a) at least a first and second fixed bed regenerative heat exchanger each including a chamber having a gas permeable heat exchange packing therein;

(b) a combustion chamber;

(c) gas flow conduit means connecting each said heat exchanger to said combustion chamber to allow gas to flow serially through one heat exchanger to said combustion chamber and from said combustion chamber through the other of said heat exchangers, said gas flow conduit means further including means to periodically reverse the direction of said flow;

(d) control means associated with each of said heat exchangers for regulating the portion of the gas passing therethrough which is passed through the heat exchange packing therein; and, wherein said control means includes at least one conduit extending through said packing.

3. The system as defined in claim 2 wherein said control means further includes a valve located in said conduit.

4. The system as defined in claim 1 wherein said control means includes a gas flow control valve means.

5. The system as defined in claim 4 wherein said valve means is located in said chamber.

6. The system as defined in claim 1 wherein said control means comprises a valve means.

7. In a fixed bed regenerative incincerator system including at least first and second fixed bed regenerative heat exchangers each containing a gas permeable heat exchanging packing and interconnnected in gas flow relationship by an intermediate incineration chamber, with each heat exchanger having means for receiving or discharging gas on the side opposite said incineration chamber, the improvement wherein each said first and second heat exchangers include control means for permitting controllable amounts of gas to pass through said heat exchangers without passing through said packing when gas is either going to or coming from said incineration chamber.

8. The system as defined in claim 7 wherein said control means comprise at least one conduit extending through said packing.

9. The system as defined in claim 7 wherein said control means comprise separate conduits in each of said first and second heat exchangers.

10. The system as defined in claim 9 wherein said control means further comprises separate valves in each of said conduits.

11. The system as defined in claim 9 wherein said separate valves are independently operable.

12. A method of operating a fixed bed regenerative incinerator system of the type including at least first and second fixed bed regenerative heat exchangers each containing a gas permeable heat exchanging packing and interconnected in gas flow relationship by an intermediate incineration chamber comprising the steps of:

(a) supplying a gas mixture of air and combustibles through the first heat exchanger in heat exchanger relationship with the packing therein and thereafter delivering said mixture to said incineration chamber;

(b) supplying fuel to said incineration chamber and burning it in said chamber in conjunction with said gas mixture of air and combustibles supplied through said first heat exchanger;

(c) exhausting the combustion products from said chamber through said second heat exchanger in heat exchanger relationship with the packing contained therein;

(d) monitoring a parameter indicative of the quantity of combustibles in the gas mixture supplied through said first heat exchanger to said incineration chamber; and, (e) when the quantity of said combustibles reach a predetermined level stopping the flow of fuel to said incineration chamber while diverting a portion of the gas mixture supplied through said first heat exchanger out of heat exchange relationship with the packing therein.

13. The method as defined in claim 12 including the additional step of increasing the portion of gas mixture diverted if the quantity of said combustibles rises above said predetermined level.

14. The method as defined in claim 12 including the additional step of diverting a portion of the exhaust gases passing through said second heat exchanger out of heat exchange relationship with the packing therein when the quantity of said combustibles reach said predetermined level.

15. The method as defined in claim 12 including the step of reducing the quantity of fuel supplied to said incineration chamber as the quantity of said combustibles increase toward said predetermined level.

16. The method as defined in claim 12 wherein the parameters monitored are the temperature and pressure in said incineration chamber.

17. A method of operating a fixed bed regenerative incinerator system of the type including at least first and second fixed bed regenerative heat exchangers each contining a gas permeable heat exchanging packing and interconnected gas flow relationship by an intermediate incineration chamber comprising the steps of:

(a) supplying a gas mixture of air and combustibles through the first heat exchanger in heat exchanger relationship with the packing therein and thereafter delivering said mixture to said incineration chamber;

(b) supplying fuel to said incineration chamber and buring it in said chamber in conjunction with said gas mixture of air and combustibles supplied through said first heat exchanger;

(c) exhausting the combustion products from said chamber through said second heat exchanger in heat exchange relationship with the packing contained therein;

(d) monitoring a parameter indicative of the quantity of combustibles in the gas mixture supplied through said first heat exchanger to said incineration chamber; and, (e) if the quantity of said combustibles increase reducing the quantity of fuel supplied to said incineration chamber and (i) diverting a portion of the exhaust gases passing through said second heat exchanger out of heat exchange relationship with the packing therein or (ii) diverting a portion of the gas mixture supplied through said first heat exchanger out of heat exchange relationship with the packing therein.

18. The method as defined in claim 17 wherein said diverted portions of step (e) are recombined with the undiverted portions prior to leaving the respective heat exchanger.

* * * * *